United States Patent [19]

Malásek et al.

[11] 4,036,265

[45] July 19, 1977

[54] DEVICE FOR SUPPORTING THE SLAY DRIVE OF A LOOM

[75] Inventors: Jaromír Málasek, Ostrava; Vladimir Kuda, Blazkovice; Pavel Dvoracek, Brno; Vladimír Horn, Brno, all of Czechoslovakia

[73] Assignee: Vyzkumny a vyvojovy ustav Zavodu vseobecneho strojirenstvi, Brno, Czechoslovakia

[21] Appl. No.: 671,116

[22] Filed: Mar. 29, 1976

Related U.S. Application Data

[63] Continuation-in-part of Ser. No. 258,348, May 31, 1972, abandoned.

[30] Foreign Application Priority Data

June 2, 1971 Czechoslovakia ..... 4033/71

[51] Int. Cl.[2] ..... D03D 49/60

[52] U.S. Cl. ..... 139/190

[58] Field of Search ..... 139/188, 190

[56] References Cited

U.S. PATENT DOCUMENTS

| | | | |
|---|---|---|---|
| 2,722,950 | 11/1955 | Izquierdo | 139/190 |
| 3,425,459 | 3/1967 | Volpe | 139/190 |
| 3,593,752 | 6/1971 | Moessinger | 139/188 |

FOREIGN PATENT DOCUMENTS

| | | | |
|---|---|---|---|
| 200,343 | 12/1938 | Switzerland | 139/190 |

*Primary Examiner*—Henry S. Jaudon

[57] ABSTRACT

A device for supporting the slay drive of a loom such device is especially advantageous in a high-speed loom with a great working width. Two transmission mechanisms are used, these being placed between the loom sides. The device has a housing assembly including a box having a center part, to both ends of which there are affixed gear boxes; to the opposite sides of the center part there are secured exchangeable terminal parts of the said box, the terminal parts being fixed to the sides of the loom. A main shaft is journalled in one of the terminal parts, in the adjacent gear box and in a portion of the center part, the main shaft being connected with a driven shaft in the center part by means of gears. The transmission mechanisms are mounted in the gear boxes, the transmission mechanisms being connected to a cross bar bearing swords upon which the slay is mounted.

2 Claims, 2 Drawing Figures

FIG. 1
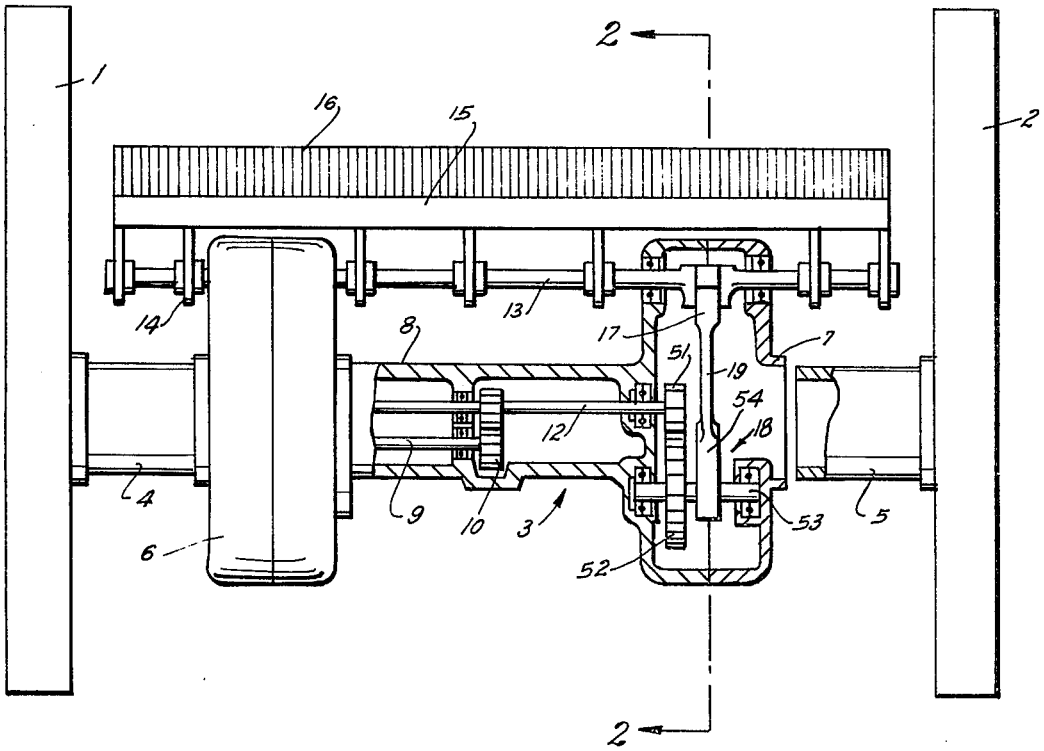
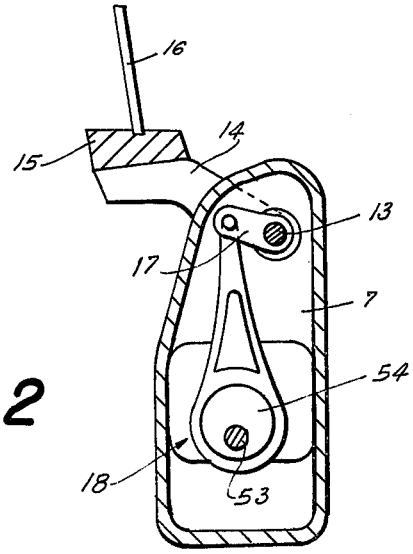
FIG. 2

DEVICE FOR SUPPORTING THE SLAY DRIVE OF A LOOM

This is a continuation-in-part of application Ser. No. 258,348 filed May 31, 1972, now abandoned.

The invention relates to a supporting device for the driving mechanism of a weaving loom slay or batten.

A hitherto known driving mechanism for the slay of a loom includes a transmission device which is placed either directly in the side of the weaving loom frame or in a separate box on the side of the loom. A shaft is attached to the lever on the exit side of the transmission device, the shaft being pivoted in a bearing in the opposite side of the loom frame. Swords are attached to the shaft, to the opposite ends of which the slay is fastened.

Another embodiment is also known in which a carrier is fixed between the sides of the loom, to which two boxes containing the transmission mechanisms are separately attached. The slay is attached in the usual way to the elements on the exit side of both mechanisms. The transmission mechanisms are driven by a shaft which is pivoted either in one or both sides of the loom, the shaft passing through both boxes and being connected with the first elements of the transmission mechanisms.

The disadvantage of this last-described arrangement consists in a considerable noisiness caused by vibrations produced by the irregular speed of the moving parts, especially those of the slay, which moves with great dwells and accelerations. The noisiness is evident mostly on looms with new systems of weft insertion, rotating at great speed and producing a fabric of considerable width. On these looms especially an increase in the stiffness of the slay might reduce the noisiness; with such added stiffness, however, the mass and consequent inertia therof are simultaneously increased. The increase of inertia mass causes, however, an increase in the vibrations and of the consequent noisiness. Further deterioration of the conditions described is caused by the use of special devices, e.g., for weft guiding, mounted on the slay of some types of weaving looms. In most cases these special devices increase the inertia mass of the slay without a proportional increase of its stiffness.

A further disadvantage of the known arrangements especially on looms with a greater width, is the difficulty of obtaining a condition of coaxiality of the shafts and the pins of the whole mechanism; as a result, to a greater or lesser extent, a misalignment of the individual parts of the mechanism takes place and the rate of wear thereof is consequently increased.

The embodiment with two boxes attached to the carrier has eliminated to a considerable extent the disadvantages described. It has, however, a number of further disadvantages. One of these disadvantages is the action of pressure of the beat-up and of the inertia force of the slay on a relatively large arm; since the boxes carrying the arm are on the carrier, undesired vibrations are thus transferred to the whole loom.

The separate mounting of each box requires a perfect sealing of the drive shaft in order to avoid oil leakage from the boxes; in such boxes, in addition, the circulation of the oil contained therein is considerably limited.

A further disadvantage consists in the fact that either the whole carrier has to be replaced, or a carrier of different length has to be used, when the whole supporting device is used on a loom of different working width; this considerably limits the general use of the parts.

A considerably relevant disadvantage is the fact that the through drive shaft is periodically subjected to different torsions as changes in the lead at the connecting points of the transmission mechanisms occur, especially on looms with wider working widths; this becomes evident by vibrations and by the retarded motion of that part of the slay mounted on the remote end of the drive shaft.

The disadvantages mentioned are eliminated by the device according to this invention. Such device comprises one box having a center part, to both ends of which gear boxes are fixed, and to which the opposite side exchangeable terminal parts of the box are attached, these being fixed to the sides of the loom. The main shaft is journalled in one of the terminal parts, in the adjacent gear boxes and in a portion of the center part. The main shaft is connected with the driven shaft in the center part by means of gears; the transmission mechanisms are attached to both ends of the driven shaft in the gear boxes.

An advantage of the arrangement according to the invention consists in an essentially reduced noisiness and in smooth running of the whole loom since, to a considerable extent, the vibrations of the moving parts, especially of the slay, are eliminated even when their stiffness is relatively low. This is due to the fact that the beat-up pressures and the inertia forces of the slay act on a considerably shorter arm.

A further advantage is that the whole drive shaft is mounted in the inner space of one box, thus eliminating its sealing in order to avoid oil leakage.

A further advantage is that both transmission mechanisms and the driven shaft are mounted in a closed space, this being advantageous for oil circulation.

A further advantage is the universal use of the supporting device on looms of different widths, which can be achieved by replacing one or both replaceable terminal parts of the box by parts of different length, while keeping all other parts of the box.

A futher advantage is the symmetrical distribution of the driven shaft torsion, since the transmission mechanisms of the slay drive are attached at the same equal distances. This becomes evident in a smooth and uniform motion of the whole slay of the loom.

An exemplary embodiment is illustrated in the drawing, in which

FIG. 1 is a schematic view in front elevation of the supporting device with the slay being inserted between the sides of the loom, with a portion of the device broken away to show the structure of one of the transmissions thereof; and FIG. 2 is a view in transverse section of the supporting device with the slay taken along line 2–2 of FIG. 1.

Between the sides 1 and 2 of a weaving loom frame (not otherwise illustrated) there is mounted a housing assembly including a box 3, such box at the same time serving to interconnect the sides 1 and 2. The box 3 is formed of an assembly of two terminal parts 4 and 5 attached to the sides 1 and 2, respectively, of two gear boxes 6 and 7, fixed to the opposite ends of the terminal parts 4 and 5, and finally of center part 8 attached to both gear boxes 6 and 7. All parts are interconnected by machine screws (not shown).

A main shaft 9 is placed in one or the other terminal parts 4 or 5, shaft 9 extending through the adjacent gear box 6 or 7 and terminating in the middle of the center part 8 at the gear 10 which is affixed thereto. Gear 10 meshes with the next gear 11, affixed to the driven shaft 12. The driven shaft 12 is mounted in the center part 8 and extends into both gear boxes 6 and 7, and is journalled in bearings therein. Transmission mechanisms 18 mounted within the gear boxes are attached to the opposite ends of the driven shaft 12. The transmission mechanisms 18, which may, for example, be cam and cam-following lever systems, transform rotary to oscillatory motion.

In the illustrative embodiment of transmission 18, such transmission includes a pair of spur gears 51, 52 for coupling the associated end of the driven shaft 12 with a camshaft, 53. The shaft 53 carries a cam or eccentric 54, upon which is mounted one end of a connecting rod 19. The other end of the connecting rod 19 is fixedly connected to a crank arm 17, such crank arm being fixedly connected to a slay shaft 13, upon which the slay 15 and reed 16 are mounted.

The slay shaft 13 pases through and is journalled in bearings in gear boxes 6 and 7. To the shaft 13, outside the gear boxes 6 and 7, there is attached a system of swords 14, a slay 15 being fastened to the opposite ends of the swords. A reed 16 is mounted in the slay 15; other unillustrated devices, e.g., for weft guiding, are mounted on the slay.

After the starting of the loom, the main shaft 9 is caused to rotate by an electric motor (not shown) by means of transmission gears mounted in one of the sides 1 or 2. The rotation of the main shaft 9 is transmitted by the gears 10 and 11 to the drive shaft 12 and from this to two transmission mechanisms in the boxes 6 and 7 for the mechanisms for translating the rotary motion of shaft 12 into an oscillatory motion of the shaft 13 and thus into a swinging movement of the slay 15 and reed 16.

When installation of the supporting device on a weaving loom of another working width is required, the whole supporting device is used except its terminal parts 4 and 5, these being replaced by others having the necessary length. The invention can be employed in all types of weaving looms and especially when general use of the parts of a related series of machines is required.

Although the invention has been illustrated and described with reference to one preferred embodiment thereof, it is to be expressly understood that it is in no way limited to the diclosure of such a preferred embodiment, but is capable of numerous modifications within the scope of the appended claims.

What is claimed is:

1. In an apparatus for supporting a slay drive in a loom having a pair of spaced side members, the drive including a mutually cooperating main shaft, driven shaft and slay shaft, the apparatus comprising a self-supporting closed housing extending between the side members and receiving the main and driven shafts, the housing including a center part having a pair of gear boxes disposed on opposed outer ends thereof and a pair of end pieces individually extending between the respective gearboxes and the adjacent side members of the loom, each end piece being removably affixed to the associated gear box and side member, means disposed in each gear box for journalling spaced portions of the slay shaft, meansfor supporting the driven shaft in the central portion of the housing with the ends of the driven shaft terminating in the respective gear boxes, means disposed in the housing for rotatably coupling the main and driven shafts, and motion-changing means disposed in each gear box and associated with the driven shaft and the slay shaft journalling means for converting the rotational movement imparted to the driven shaft by the main shaft into an oscillatory motion of the slay shaft.

2. Apparatus as defined in claim 1, in which the rotational coupling means are disposed at the center of the driven shaft to symmetrically drive the motion-changing means in the respective gear boxes.

* * * * *